US006538887B2

(12) United States Patent
Belady et al.

(10) Patent No.: US 6,538,887 B2
(45) Date of Patent: Mar. 25, 2003

(54) FAN BLADE PROVIDING ENHANCED PERFORMANCE IN AIR MOVEMENT

(75) Inventors: Christian L Belady, McKinney, TX (US); Roy M. Zeighami, Piano, TX (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/915,604

(22) Filed: Jul. 26, 2001

(65) Prior Publication Data

US 2003/0021089 A1 Jan. 30, 2003

(51) Int. Cl.[7] ..... H05K 7/20
(52) U.S. Cl. ..... 361/695; 415/200; 415/208.2
(58) Field of Search ..... 361/687–688, 361/694–697; 454/184; 415/200, 181, 119, 208.2, 177–178; 416/95, 228, 241 A, 208.2, 236 A

(56) References Cited

U.S. PATENT DOCUMENTS 4,720,239 A * 1/1988 Owezarek ..... 415/181
5,193,983 A * 3/1993 Shyu ..... 416/236 A
5,480,284 A 1/1996 Wadia et al. ..... 416/91
5,927,944 A 7/1999 Belady ..... 415/220
6,126,395 A * 10/2000 Shingai ..... 415/200
6,162,136 A 12/2000 Aoyama ..... 473/383
6,183,197 B1 * 2/2001 Bunker et al. ..... 416/95

OTHER PUBLICATIONS

"Fan Handbook, Selection Application & Design" by Frank P. Bleier, McGraw Hill 1997, pp. 2.4–2.7 and pp. 4.28–4.33.
All You Need to Know About Fans by Mike Turner et al., printed from Internet site 222.electronics–cooling.com/Resources/EC_Articles/May 1996.
Application Ser. No. 09/867,194 filed May 29, 2001, Inventor Christian Belady.

* cited by examiner

*Primary Examiner*—Gregory Thompson

(57) ABSTRACT

A system and method are disclosed which include at least one blade implemented within an air moving device to enable enhanced performance of such air moving device. In one embodiment, an air moving device is disclosed that is operable to generate a flow of air from a low pressure region to a high pressure region. The air moving device comprises at least one blade that is operable to generate a flow of air as a result of movement thereof. The blade(s) include a rough surface on a side facing the low pressure region, and such rough surface is arranged to induce a turbulent boundary layer that enables operation of the air moving device in a manner that would otherwise result in separation of air from the blade(s). The rough surface may be formed by dimples or bumps, as examples, arranged on the surface of the blade(s).

20 Claims, 3 Drawing Sheets

FAN BLADE PROVIDING ENHANCED PERFORMANCE IN AIR MOVEMENT

RELATED APPLICATIONS

This application is related to co-pending and commonly assigned U.S. patent application Ser. No. 09/867,194 entitled "ENHANCED PERFORMANCE FAN WITH THE USE OF WINGLETS" filed May 29, 2001, the disclosure of which is hereby incorporated herein by reference.

TECHNICAL FIELD

This invention relates in general to air moving devices, such as fans and blowers, and more specifically to blades for use in such air moving devices that are configured having a roughened surface, e.g., with dimples or ribs, to induce a turbulent boundary layer, which enables enhanced performance in air movement provided by such blades by delaying air separation during operation.

BACKGROUND

Air moving devices, such as fans and blowers, are becoming an increasingly important aspect of system cooling designs in today's electronics. It is often desirable to provide an electronic device with great functionality and relatively small size. Thus, it is often important to generate as much performance as possible from air moving devices without being required to increase the size of such air moving devices. That is, it is often desirable to generate greater performance (e.g., greater air flow) for an air moving device of a given size without being required to increase the size of such air moving device. Development efforts for cooling systems of the prior art have primarily been focused on improving cooling techniques (e.g:, improving the performance of active sub-cooling modules, including compressors, evaporators, etcetera, as well as passive cooling modules, such as heat sinks), but fan blade designs have generally been overlooked. That is, relatively little focus has been placed on improving fan blade design to enhance performance of cooling systems.

In typical implementations of the prior art, the performance of air moving devices, such as fans, has been limited by the angle of attack of the fan blades because of the occurrence of air separation off of the top side (or low pressure intake side) of the blades. In many cases, the angle of attack of the blades dictates the maximum speed at which the air moving device can operate efficiently due to separation. "Separation" is defined as when the boundary layer of the fan separates from the surface of the blade. This is analogous, for example, to when separation occurs off of an aircraft wing, which is generally referred to as a "stall" wherein lift is lost. As is well known in the art, such air separation behavior may be encountered during operation of a fan blade implementation, at which point there is a significant decrease in fan performance. Accordingly, a desire exists for a blade configuration that delays the point at which separation occurs to enable improved performance of an air moving device.

SUMMARY OF THE INVENTION

The present invention is directed to a system and method which include at least one blade implemented within an air moving device to enable enhanced performance of such air moving device. According to at least one embodiment, the blade(s) of an air moving device are implemented with a rough surface to effectively delay the operational point at which air separation from the blade(s) is encountered, thereby enabling enhanced performance of the air moving device without requiring an increase in fan blade size. In one embodiment, dimples are arranged on the blade(s), in a similar manner to dimples arranged on a golf ball, to provide a rough surface that improves the aerodynamic performance of such blade(s).

According to one embodiment of the present invention, an air moving device is disclosed that is operable to generate a flow of air from a low pressure region to a high pressure region. The air moving device comprises at least one blade that is operable to generate a flow of air as a result of movement thereof. The blade(s) include a rough surface on a side facing the low pressure region, and such rough surface is arranged to induce a turbulent boundary layer that enables operation of the air moving device in a manner that would otherwise result in separation of air from the blade(s).

According to another embodiment of the present invention, a system is disclosed that comprises an air moving device operable to generate a flow of air from a low pressure region to a high pressure region. The air moving device includes at least one blade operable to generate the flow of air as a result of movement thereof. The blade(s) include a means, arranged on a side facing the low pressure region, for inducing a turbulent boundary layer to enable operation of the air moving device within an operating region that would otherwise result in separation of air from the blade(s).

According to yet another embodiment of the present invention, a method of generating air movement is disclosed, which comprises utilizing an air movement device that is operable to generate a flow of air from a low pressure region to a high pressure region. The air movement device includes at least one blade operable to generate the flow of air as a result of movement thereof, and the blade(s) include a rough surface arranged on a side facing the low pressure region. The method further comprises operating the air movement device within an operating region, wherein the rough surface induces a turbulent boundary layer to avoid encountering an aerodynamic stall that would otherwise be encountered within such operating region.

DETAILED DESCRIPTION

Figure 1A:
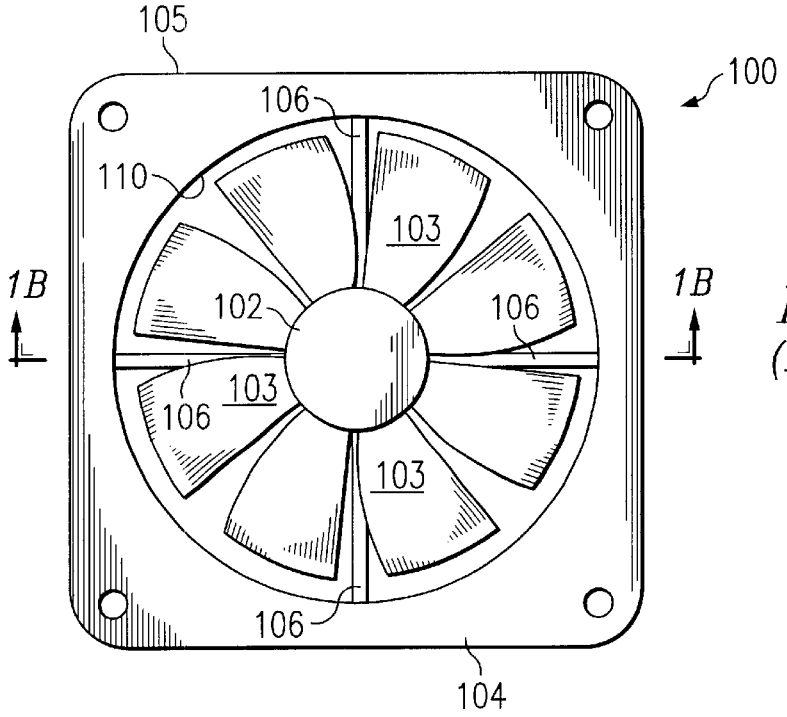
FIG. 1A (PRIOR ART)
FIGS. 1A–1C show a typical fan configuration of the prior art.

Various embodiments of the present invention are now described with reference to the above Figs, wherein like reference numerals represent like parts throughout the several views. Various embodiments of the present invention provide a blade configuration for use within air moving devices, such as fans and blowers (e.g., centrifugal blowers). In general, fans and blowers differ in their flow and pressure characteristics. Typically, fans deliver air in an overall direction that is parallel to the fan blade axis and can be designed to deliver a high flow rate, but tend to work against low pressure. Blowers typically tend to deliver air in a direction that is perpendicular to the blower axis at a relatively low flow rate, but against high pressure. While various embodiments are described hereafter in conjunction with a fan configuration, it should be recognized that blades according to various embodiments of the present invention may be implemented within any type of air moving device, including blowers.

Figure 1B:
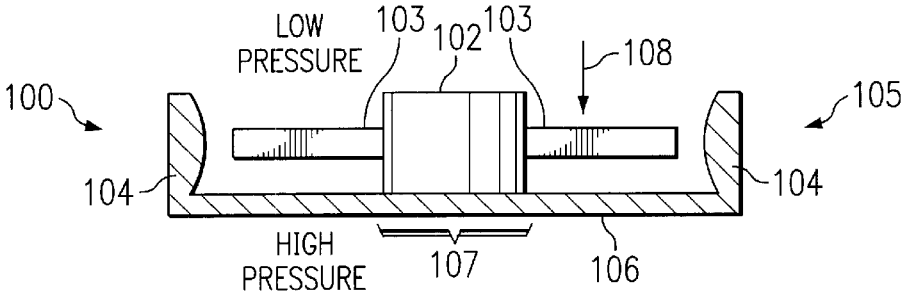
FIG. 1B (PRIOR ART)
Figure 1C:
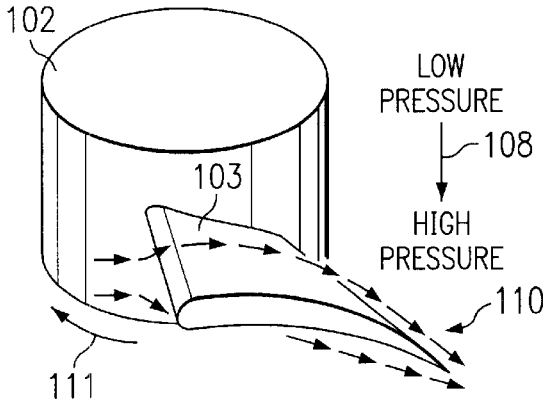
FIG. 1C (PRIOR ART)

Turning to FIGS. 1A–1C, atypical fan configuration is shown. More specifically, FIGS. 1A, 1B, and 1C are respectively a top view, a cross sectional view, and a schematic partial perspective view depicting a typical fan 100. Fan 100 may, for example, be implemented for cooling electronic components. For instance, fan 100 may be implemented within a cooling system of a personal computer (PC) for providing air movement for cooling electronic circuitry therein. As shown in the example of FIGS. 1A–1C, hub 102 is rotatably mounted on a base 105 that includes an open interior region spanned by struts 106. Struts 106 support a central location 107 within base 105, onto which hub 102 is rotatably mounted. A plurality of blades 103 (which may be referred to herein as propeller blades) are attached to hub 102, and a motor (not shown) attached to hub 102 causes hub 102 and attached blades 103 to rotate in a direction indicated by arrow 111, creating air flow in a direction indicated by arrow 108. In certain configurations, fan 100 may be designed to work so air flow is in the direction opposite to that indicated by arrow 108. Base 105 further includes a stationary venturi 104 having an inner surface that is relatively closely spaced radially beyond the distal ends of rotating blades 103.

FIG. 1C shows, for simplicity, a single one of blades 103, which is attached radially to hub 102. Hub 102 is mounted rotatably on base 105 (not shown in FIG. 1C). Hub 102 and attached blades 103 rotate in a direction indicated by arrow 111, creating primary air flow (or "generated air flow") in a direction indicated by arrow 108. The primary air flow in direction 108 creates an air pressure gradient between the top (or low pressure intake side) and the bottom (or high pressure outlet side) of blades 103. Thus, in general, as fan blades 103 rotate, they generate primary air flow in the direction 108.

Further, as fan blades 103 rotate, air flows around the surface of such fan blades, as is well known in the aerodynamic arts and as is further described hereafter. At some separation point, the air stream separates from the surface of blades 103 and generates a large turbulent flow area, which may be referred to as a wake, behind (or on the top side) of blades 103. Such separation point is a function of the speed of rotation of blades 103, the angle of attack, and pressure. As described further hereafter, the wake generated from such air separation has low pressure, and results in inefficient performance of fan 100. That is, air separation from blades 103 is undesirable as it results in inefficient performance (e.g., reduced air movement) of fan 100. Further, as discussed below, the occurrence of air separation from blades 103 of fan 100 reduces the ability to provide lift (or to generate pressure) causing an "aerodynamic stall," which results in an increase in noise and decrease in aerodynamic efficiency. In other words, separation results in less pressure differential across the blades of a fan, which hinders its performance.

Thus, it is desirable to implement a fan blade of a given size in a manner that delays the operational point at which separation is encountered for operation of such fan blade. If separation can be delayed for a given fan blade, then the operational variables of which separation is a function (e.g., speed of blade rotation, angle of attack, and pressure) may be altered to enable greater performance (e.g., greater generated air flow) from a fan blade of a given size without encountering separation. For instance, by implementing a blade of a given size in accordance with various embodiments of the present invention which enable the operational point at which separation is encountered to be delayed, the angle of attack of such blade may be altered to enable greater generation of air flow than may otherwise be achieved by such blade. Therefore, by implementing a fan blade in accordance with various embodiments of the present invention, the performance of such fan may be enhanced without requiring that the fan blade size be increased.

Figure 2A:
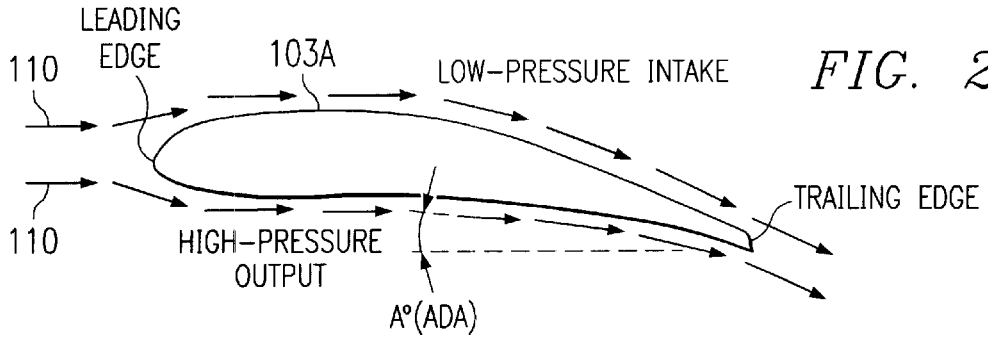
FIG. 2A shows a cross section of an air foil to illustrate basic aerodynamic principles of a fan blade having a first angle of attack A°, wherein the stream of flow is smooth and follows the contours of the airfoil.
Figure 2B:
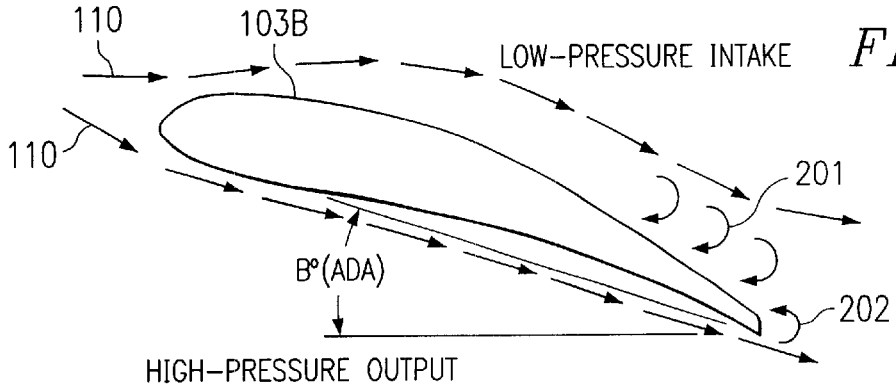
FIG. 2B shows a cross section of an air foil to illustrate basic aerodynamic principles of a fan blade having a second angle of attack B°, wherein separation of the stream of flow from the airfoil is encountered.

To better understand the occurrence of separation within a fan, basic aerodynamic principles of a fan are briefly described in conjunction with FIGS. 2A and 2B. FIG. 2A shows a cross section of an air foil utilizing a cross-section view of a first fan blade 103A implemented with a first angle of attack, and FIG. 2B shows a cross section of an air foil utilizing a cross-section view of a second fan blade 103B implemented with a second angle of attack. In general, the aerodynamic principles associated with fan blades typically resemble those of a wing of an airplane. For example, fan blades 103A and 103B produce lift when their respective chord, which is an imaginary line extending from the leading edge to the trailing edge of each of blades 103A and 103B, is elevated from the direction of the free stream of flow 110, as shown in FIGS. 2A and 2B. The elevation angle is commonly referred to as the angle of attack (AOA). As mentioned above, when an AOA is reached where the air will no longer flow smoothly and begins to separate from the blades (as in FIG. 2B), an "aerodynamic stall" condition exists.

Air separation (or aerodynamic stall) is a well known phenomenon within air moving devices, and is known by those of ordinary skill in the art to cause a significant decrease in the performance of air moving devices. Accordingly, it is desirable to avoid or delay the operational point at which such separation occurs within air moving devices in order to enhance their performance. In typical implementations of the prior art, the performance of air moving devices, such as fans, has been limited by the occurrence of air separation off of the top side (or low-pressure intake side or "suction side") of the blades. For instance, operational characteristics that effect separation, such as AOA, rotation speed, and back pressure generation have been limited in prior art fan implementations because of the occurrence of separation. For instance, it may be desirable to increase one or more of AOA, rotation speed, and maximum allowable back pressure generation (e.g., by increasing the density of the system in which the fan is implemented) for a blade of a given size in order to enhance its performance, but separation limits the amount of enhancement that can be achieved.

For example, FIG. 2A shows blade 103A implemented with a first angle of attack A° (e.g., 5° AOA), while FIG. 2B shows blade 103B having the same size implemented with a much greater angle of attack B° (e.g., 16° AOA). In the examples of FIGS. 2A and 2B, blades 103A and 103B have the same size and are implemented within like fan systems (e.g., operate at the same rotational speed). However, blade 103A is implemented at an AOA A° such that the stream of flow 110 is smooth and follows the contours of the airfoil, while blade 103B is implemented at an AOA B° such that the airfoil stalls and separation of the stream of flow 110 occurs at the trailing edge and at the suction side of the airfoil, with small eddies 201 and 202 filling the suction zones. The separation that occurs in the example of FIG. 2B causes an aerodynamic stall, which results in a decrease in the lift coefficient of fan blade 103B, thereby decreasing the amount of airflow generated by (or output by) fan blade 103B. That is, the separation of the stream of flow 110 from the contours of the airfoil results in less pressure differential across blades 103B, which hinders its performance.

Because of the degrading effect that separation has on performance of air moving devices, in most prior art configurations, designers limit the operation of air moving devices in a manner to try to avoid the occurrence of separation. For instance, designers limit such operational characteristics as AOA, rotation speed, and back pressure in order to avoid separation. Accordingly, separation commonly presents a limitation as to the speed of rotation, AOA, and/or back pressure in prior art air movement devices, thereby limiting the performance (e.g., amount of air movement) that may be recognized by such prior art air movement devices.

Air separation occurs not only within air moving devices, such as fans, but is encountered in many different scenarios. For instance, when a golf ball is struck causing it to fly through the air, such golf ball may reach a point at which air separation occurs (i.e., air separates from the surface of the golf ball), thereby resulting in a negative aerodynamic effect on the golf ball and decreasing the distance that such golf ball travels. For many years, golf balls have been designed with various types and arrangements of dimples thereon to delay the occurrence of separation. In the case of a golf ball, dimples are commonly used to induce a turbulent boundary layer, which prevents separation and thus allows the ball to travel further.

According to various embodiments of the present invention, fan blades are configured in a manner to induce a turbulent boundary layer in order to delay separation and provide enhanced performance. For example, according to at least one embodiment of the present invention, fan blades are configured having a rough surface (e.g., dimples) arranged at least on their low pressure side (or top side), which promotes a turbulent boundary layer that delays separation, thereby enabling enhanced performance in the blades generating air movement. That is, a roughened surface provided on the low pressure side of the fan blade is arranged to trip the boundary layer to promote turbulence and delay separation. Because of the resulting delay in the operational point at which separation occurs, higher rotation speeds, greater generation of back pressure, and/or greater AOA may be enabled for the fan blades, which may not be possible otherwise without encountering separation. Thus, by implementing fan blades in accordance with embodiments of the present invention, a fan may provide greater air flow and/or may be capable of being utilized for cooling electronic components within a system having greater density than may otherwise be achieved by a fan of like size. Accordingly, various embodiments of the present invention may provide fan blade configurations that enable enhanced performance of air movement devices in which such fan blades are implemented.

It should be understood that as used herein the term "rough surface" is intended to encompass abrasive, barky, bumpy, coarser costate, cragged, leprose, ribbed, rugged, textured, and unsmooth surfaces. According to various embodiments, such rough surface of a blade comprises one or more obstructions (e.g., dimples or bumps) arranged to trigger a turbulent boundary layer to delay separation. Accordingly, such obstructions may be referred to herein as turbulent boundary layer triggers (or turbulent boundary layer tripping mechanisms). According to at least one embodiment the roughness of the fan blade surface may be expressed as a ratio (or epsilon "$\epsilon$") of the characteristic roughness dimension (e.g., dimple depth or bump height) of a blade to the blade's chord length (i.e., "$\epsilon$=characteristic roughness dimension/chord length"). According to at least one embodiment, the ratio (or "$\epsilon$," which defines a non-dimensional surface roughness for the blade) of "characteristic roughness dimension/chord length" is at least 1/100. In certain embodiments, such ratio "$\epsilon$" is approximately 1/10,000. Of course, according to at least one embodiment, the ratio "$\epsilon$" may be any value within the range of approximately 1/100 to approximately 1/10,000. While specific values of blade "roughness" are described above for exemplary embodiments, it should be understood that other embodiments of the present invention are not intended to be limited to the specific values described above, but may instead have any other amount of roughness that is suitable to sufficiently trigger a turbulent boundary layer to delay the operational point at which separation is encountered on a blade.

Figure 3:
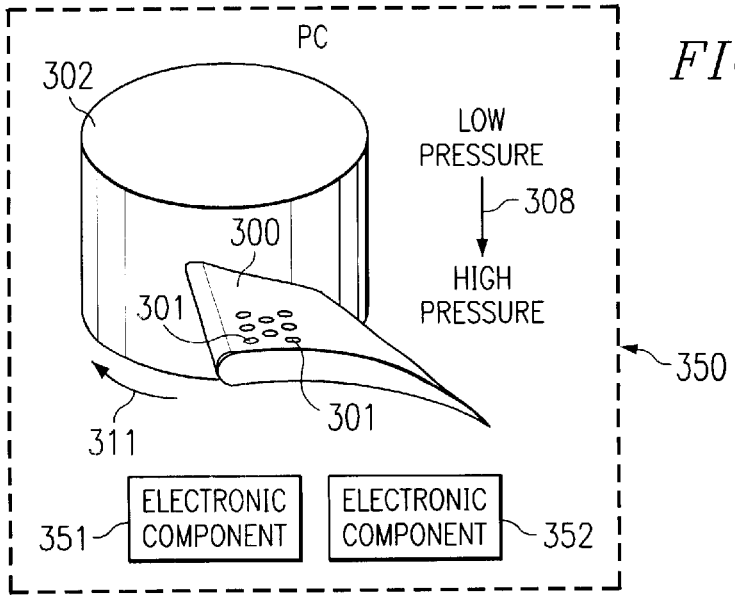
FIG. 3 shows an exemplary fan blade having a rough surface according to one embodiment of the present invention.

Turning to FIG. 3, an exemplary fan blade 300 is shown, which has a rough surface according to one embodiment of the present invention. More specifically, FIG. 3 shows, for simplicity, a single blade 300 attached radially to hub 302. According to various implementations, any number of blades 300 may be so attached to hub 302. Hub 302 may be mounted rotatably on a base (not shown in FIG. 3). Hub 302 and attached blade(s) 300 rotate in a direction indicated by arrow 311, creating primary air flow (or generated air flow) in a direction indicated by arrow 308. The primary air flow in direction 308 creates an air pressure gradient between the top (or low pressure intake side) and the bottom (or high pressure outlet side) of blade(s) 300.

In the example of FIG. 3, dimples 301 are implemented on the top side (or low pressure intake side) of blade(s) 300. Such dimples 301 may, for example, be similar to dimples commonly implemented on golf balls. According to the exemplary embodiment shown in FIG. 3, dimples 301 work to promote a turbulent boundary layer to promote turbulence and delay separation for blade(s) 300. As a result of the delayed separation, higher rotation speeds, greater generation of back pressure, and/or greater AOA may be enabled for fan blade(s) 300 without encountering separation. Accordingly, blade(s) 300 may be implemented within an air moving device in a manner that enables enhanced performance of such air movement device (e.g., implemented with an increased AOA) without requiring an increase in the size of such blade(s) 300.

Figure 4:
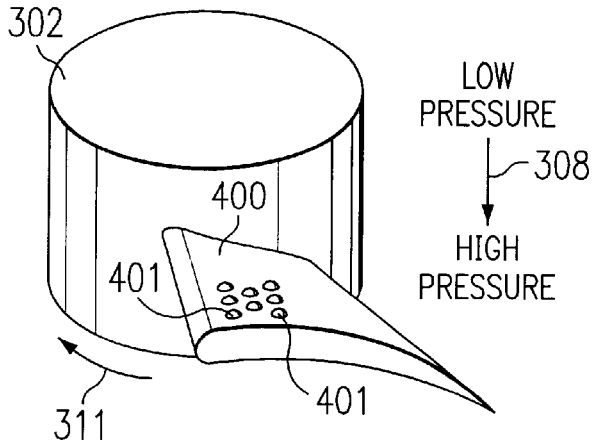
FIG. 4 shows an exemplary fan blade having a rough surface according to another embodiment of the present invention.

Turning now to FIG. 4, a further exemplary fan blade 400 is shown, which has a rough surface according to another embodiment of the present invention. As with FIG. 3, FIG. 4 shows, for simplicity, a single blade 400 attached radially to hub 302. According to various implementations, any number of blades 400 may be so attached to hub 302. Hub 302 may be mounted rotatably on a base (not shown in FIG. 4). Hub 302 and attached blade(s) 400 rotate in a direction indicated by arrow 311, creating primary air flow (or generated air flow) in a direction indicated by arrow 308. The primary air flow in direction 308 creates an air pressure gradient between the top (or low pressure intake side) and the bottom (or high pressure outlet side) of blade(s) 400.

In the example of FIG. 4, raised portions (e.g., bumps or ridges) 401 are implemented on the top side (or low pressure intake side) of blade(s) 400. Such bumps 401 may, for example, be similar to the inverse of dimples commonly implemented on golf balls. According to the exemplary embodiment shown in FIG. 4, bumps 401 work to promote a turbulent boundary layer to promote turbulence and delay separation for blade(s) 400. As a result of the delayed separation, higher rotation speeds, greater generation of back pressure, and/or greater AOA may be enabled for fan blade(s) 400 without encountering separation. Accordingly, blade(s) 400 may be implemented in a manner within an air moving device to enable enhanced performance of such air movement device (e.g., implemented with an increased AOA) without requiring an increase in the size of such blade(s) 400.

Thus, according to various embodiments, a rough surface may be implemented on fan blades to promote a turbulent boundary layer, thereby delaying the operational point at which separation occurs. Such rough surface may be the result of dimples arranged on the surface of a blade in certain embodiments (such as shown in the example of FIG. 3), raised portions (e.g., bumps or ridges) arranged on the surface of a blade in other embodiments (such as shown in the example of FIG. 4), or a combination of dimples and raised portions, as examples.

Figure 5:
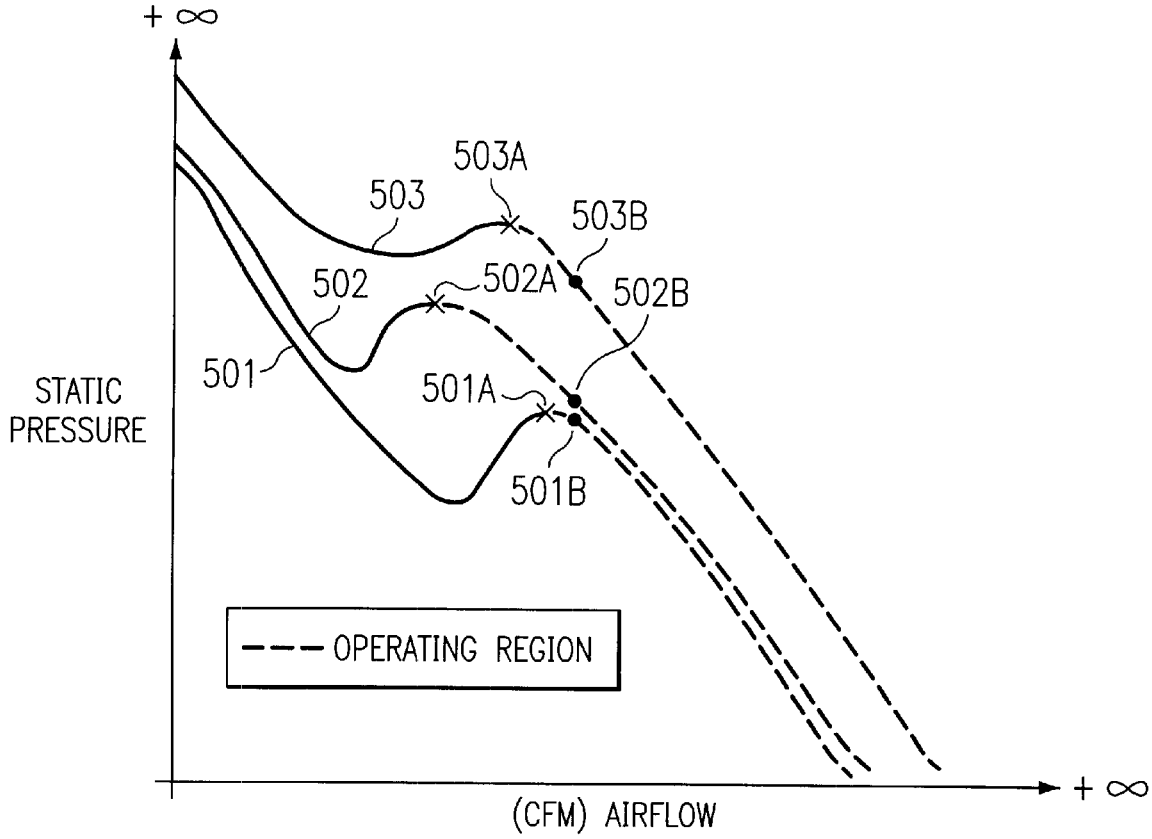
FIG. 5 shows a graph that includes three exemplary fan curves plotted thereon, which graphically illustrates delaying the operational point at which separation occurs in accordance with at least one embodiment of the present invention.

Turning now to FIG. 5, an exemplary graph 500 is provided, which illustrates aerodynamic aspects of three fans of like size and operating at the same rotational speeds. Graph 500 has as one axis static pressure and as another axis air flow in cubic feet per minute (cfm), and such fan curve 500 is typically read from right to left, beginning with healthy aerodynamic flow and progressing to an aerodynamic stall. Graph 500 includes three fan curves plotted thereon: 1) fan curve 501, which is an operational curve for a traditional fan having traditional fan blades with smooth surfaces implemented therein (e.g., fan blade 103 of FIG. 1C); 2) fan curve 502, which is an operational curve for a fan having blades implemented in accordance with an embodiment of the present invention with a rough blade surface (e.g., such as shown in FIGS. 3 and 4); and 3) fan curve 503, which is an operational curve for a fan having blades with a rough surface in accordance with an embodiment of the present invention that are arranged at a greater AOA than the blades that provide curves 501 and 502. Thus, fan curve 501 is an exemplary fan curve that may be realized with a fan implementing typical blades of the prior art, such as blades 103 described in FIG. 1C, while fan curves 502 and 503 provide exemplary curves that may be realized with a fan implementing blades configured according to at least one embodiment of the present invention (e.g., blades 300 of FIG. 3 or blades 400 of FIG. 4).

As is known in the art, fan curves include some operational point at which a stall is encountered (resulting from separation of the stream of flow from the airfoil, as discussed above in conjunction with FIGS. 2A–2B). Thus, in the example of FIG. 5, fan curve 501 has a stall point 501A, fan curve 502 has a stall point 502A, and fan curve 503 has a stall point 503A. Stall points 501A, 502A, and 503A indicate the operational point at which a stall is encountered for fans 501, 502, and 503, respectively. Generally, a fan designer desires to implement a fan to operate at the point along the fan curve that provides optimum performance without encountering a stall. More specifically, the operating regions of each fan are illustrated in FIG. 5, which are the regions in which the fans may be operated without encountering a stall. As shown, the portions of each fan curve to the right of their respective stall points (i.e., increasing along the airflow axis) are within the operating region. As the exemplary fan curves of FIG. 5 illustrate, implementing fan blades having a rough surface in accordance with embodiments of the present invention changes the operational point at which a stall (or separation) is encountered. Also, as described further below, implementing blades in accordance with embodiments of the present invention alters the operating region for a fan such that improved performance may be achieved.

Thus, for example, by implementing fan blades of the same size and same rotation speed as those plotted for fan curve 501, but having a rough surface in accordance with embodiments of the present invention, the resulting fan curve 502 having a different stall point 502A (and different operating region) is achieved. Stall point 502A occurs at a point further up the static pressure axis than stall point 501A. As FIG. 5 illustrates, the operating region of the fan plotted by curve 502 is improved over the typical fan curve 501. For instance, the operating region is moved upward along the static pressure axis, which indicates that the fan plotted by curve 502 can operate with higher system back pressure without encountering a stall than is possible with the fan plotted by curve 501. For instance, operating point 502B of curve 502 provides the same airflow as the operating point 501B of curve 501. However, operating point 502B provides greater back pressure (and can therefore be implemented within a denser system) than any operating point (including operating point 501B) available along curve 501.

Additionally, because of the enhanced aerodynamics of the fan blade having a rough surface, the blades' AOA may be increased to provide a fan plotted by curve 503. As fan curve 503 illustrates, by implementing blades in accordance with the present invention to enable the AOA to be increased, enhanced performance may be achieved for a fan. For instance, the resulting fan plotted by curve 503 has blades of the same size and rotating at the same speed as the blades of the fan plotted by curve 501, but the larger AOA of the fan plotted by curve 503, which is enabled by implementing blades in accordance with embodiments of the present invention, provides much better performance than the fan plotted by curve 501. For example, the fan plotted by curve 503 provides an operating region that is much improved over the typical fan curve 501. For instance, the operating region of curve 503 provides much greater back pressure and can therefore be utilized to provide airflow in a much denser system than may be achieved by the fan plotted by curve 501. For instance, operating point 503B of curve 503 provides the same airflow as the operating point 501B of curve 501. However, operating point 503B provides much greater back pressure (and can therefore be implemented within a denser system) than any operating point (including operating point 501B) available along curve 501. Thus, by implementing blades of embodiments of the present invention, a fan of a given size and rotation speed may be implemented to provide airflow to a system having greater density (e.g., of electronic components, such as components 351 and 352 shown in the example of FIG. 3) than would otherwise be possible for such fan. Accordingly, a system of greater density may be cooled without requiring an increase in the size of fan blades implemented for providing air flow within the system.

According to at least one embodiment, the blades of an air moving device may further comprise winglets implemented thereon, such as is disclosed in co-pending U.S. Patent application Ser. No. 09/867,194 entitled "ENHANCED PERFORMANCE FAN WITH THE USE OF WINGLETS" filed May 29, 2001, the disclosure of which has been incorporated herein by reference. Additionally, the blades and surface roughening mechanisms (e.g., dimples, bumps, etc.) of various embodiments of the present invention may be formed of any suitable material, including those commonly utilized for forming blades of air moving devices, such as plastics and metals. Further, in certain embodiments, the surface roughening mechanism may be formed as an integral part of a blade (e.g., the blade may be configured to have a rough surface), while in other embodiments such surface roughening mechanism may be a separate component capable of being coupled to a blade. For instance, in certain embodiments, a roughening mechanism may be a separate component, such as a sleeve, that is capable of being slipped over a blade to impart enhanced aerodynamic characteristics to such blade in the manner described above.

In certain embodiments, a rough surface may be implemented on both the top and bottom sides of the fan blades, which enables bi-directional operation of the blades while inducing a turbulent boundary layer in either direction of operation. Additionally, surface roughening mechanisms, such as dimples or bumps, Implemented on a blade may be arranged in any suitable manner. Thus, while an exemplary arrangement is shown in FIGS. 3 and 4 herein, the present invention is not intended to be limited to such arrangement shown. Much development has been undertaken, for example, by golf ball designers in determining optimum dimple designs and arrangements thereof that enhance the aerodynamics of a golf ball. For instance, shape, depth, and patterns of dimples may be varied to vary the aerodynamic effect of such dimples on a fan blade. Any such dimple design and arrangement now known or later discovered for improving aerodynamics may be implemented on fan blades in accordance with various embodiments of the present invention. Similarly, raised portions, such as bumps or ridges, may have any suitable design and arrangement on fan blades in accordance with certain embodiments of the present invention to enhance the aerodynamics of such fan blades and thereby enhance the performance of an air moving device in which such fan blades may be implemented.

Blades according to various embodiments of the present invention may be implemented within a fan assembly, such as that described in conjunction with FIGS. 1A–1C. Alternatively, blades of various embodiments of the present invention may be implemented in any other type of fan assembly or any other type of air moving device, and any such implementation is intended to be within the scope of the present invention. In a preferred implementation, the blades of at least one embodiment of the present invention are utilized to provide air movement for cooling electronic circuitry (e.g., electronic components 351 and 352 in the example of FIG. 3), such as within a PC (e.g., PC 350 of the example of FIG. 3), but in other implementations, the blades of various embodiments may be utilized to provide air movement within any environment.

What is claimed is:

1. An air moving device operable to generate a flow of air from a low pressure region to a high pressure region comprising:

at least one blade operable to generate said flow of air as a result of movement of said at least one blade, wherein said at least one blade includes a rough surface on a side facing said low pressure region and wherein said rough surface is arranged to induce a turbulent boundary layer that enables operation of said air moving device in a manner that would otherwise result in separation of air from said at least one blade.

2. The air moving device of claim 1 wherein said rough surface comprises one or more dimples arranged on said at least one blade.

3. The air moving device of claim 1 wherein said rough surface comprises one or more raised portions arranged on said at least one blade.

4. The air moving device of claim 3 wherein said one or more raised portions comprise bumps.

5. The air moving device of claim 1 wherein said air moving device is selected from the group consisting of:

fan and blower.

6. The air moving device of claim 1 wherein said air moving device is arranged for generating air movement for cooling one or more electronic components.

7. The air moving device of claim 1 wherein said one or more electronic components are included within a computer system.

8. The air moving device of claim 1 wherein said rough surface comprises:

ratio of characteristic roughness dimension to chord length of said at least one blade within the range of 1 in 100 to 1 in 10,000.

9. The air moving device of claim 1 wherein said operation of said air moving device in a manner that would otherwise result in separation of air from said at least one blade comprises:

said air moving device operating with said at least one blade having an angle of attack, said at least one blade having a rotation speed, and said air moving device operating with a back pressure, wherein said angle of attack, rotation speed, and back pressure form an operating point that would result in separation of air from said at least one blade absent said rough surface.

10. A system comprising:

an air moving device operable to generate a flow of air from a low pressure region to a high pressure region; and said air moving device including at least one blade operable to generate said flow of air as a result of movement of said at least one blade, wherein said at least one blade includes a means, arranged on a side facing said low pressure region, for inducing a turbulent boundary layer to enable operation of said air moving device within an operating region that would otherwise result in separation of air from said at least one blade.

11. The system of claim 10 wherein said means for inducing a turbulent boundary layer comprises one or more dimples arranged on said at least one blade.

12. The system of claim 10 wherein said means for inducing a turbulent boundary layer comprises one or more raised portions arranged on said at least one blade.

13. The system of claim 10 wherein said air moving device includes a plurality of said at least one blade.

14. The system of claim 10 further comprising:

one or more electronic components, wherein said air moving device is arranged for generating air movement for cooling said one or more electronic components.

15. The system of claim 10 wherein said means for inducing a turbulent boundary comprises said at least one blade having a ratio of characteristic roughness dimension to chord length within the range of 1 in 100 to 1 in 10,000.

16. A method of generating air movement, said method comprising the steps of:

utilizing an air movement device that is operable to generate a flow of air from a low pressure region to a high pressure region, said air movement device including at least one blade operable to generate said flow of air as a result of movement thereof and wherein said at least one blade includes a rough surface arranged on a side facing said low pressure region; and operating said air movement device within an operating region, wherein said rough surface induces a turbulent boundary layer to avoid encountering an aerodynamic stall that would otherwise be encountered within said operating region.

17. The method of claim 16 wherein said rough surface includes one or more dimples arranged on said at least one blade.

18. The method of claim 17 wherein said one or more dimples are arranged in an optimum manner for inducing a desired turbulent boundary layer for said at least one blade.

19. The method of claim 16 wherein said rough surface includes one or more raised portions arranged on said at least one blade.

20. The method of claim 16 wherein said rough surface comprises:

ratio of characteristic roughness dimension to chord length of said at least one blade within the range of 1 in 100 to 1 in 10,000.

* * * * *